US006978612B2

(12) United States Patent
Smith et al.

(10) Patent No.: US 6,978,612 B2
(45) Date of Patent: Dec. 27, 2005

(54) UTILITY DEVICE HAVING HYDRAULIC CIRCUIT FOR MULTI-FUNCTION VALVE

(75) Inventors: David R. Smith, Fort Jennings, OH (US); Mark A. Recker, Ottawa, OH (US)

(73) Assignee: Unverferth Manufacturing Company, Inc., Kalida, OH (US)

( * ) Notice: Subject to any disclaimer, the term of this patent is extended or adjusted under 35 U.S.C. 154(b) by 19 days.

(21) Appl. No.: 10/607,275

(22) Filed: Jun. 27, 2003

(65) Prior Publication Data

US 2004/0261610 A1 Dec. 30, 2004

(51) Int. Cl.[7] ..... F01B 29/08

(52) U.S. Cl. ..... 60/525; 60/536

(58) Field of Search ..... 60/525, 526, 530, 60/531, 536

(56) References Cited

U.S. PATENT DOCUMENTS 3,985,394 A * 10/1976 Rolfes ..... 180/321
6,354,081 B1 * 3/2002 Burton ..... 60/427
6,622,611 B2 * 9/2003 Nesi ..... 91/536
6,662,881 B2 * 12/2003 Domann ..... 172/272

OTHER PUBLICATIONS

"Design Engineers Handbook", 1979, Parker Hannifin Corporation, p. k(a-3).*

* cited by examiner

*Primary Examiner*—Edward K. Look
*Assistant Examiner*—Igor Kershteyn
(74) *Attorney, Agent, or Firm*—Rothwell, Figg, Ernst & Manbeck, PC

(57) ABSTRACT

A utility vehicle or other utility device includes a hydraulic circuit that enhances operative capabilities of utility mechanisms with multiple hydraulic functionality. In some embodiments, multiple functionality can include powering of one or more hydraulic motor(s) and/or one or more hydraulic cylinder(s).

17 Claims, 4 Drawing Sheets

UTILITY DEVICE HAVING HYDRAULIC CIRCUIT FOR MULTI-FUNCTION VALVE

BACKGROUND

1. Field of the Invention

The present invention relates generally to, among other things, utility devices, such as, for example, utility vehicles, including, for example, tractors, skid-steer vehicles and/or the like having hydraulic circuits.

2. Discussion of the Background

There are a variety of known utility devices, such as, e.g., utility vehicles, having hydraulic circuits, such as, e.g., for hydraulically powering tools. In many instances, utility vehicles are often used for construction and/or other utilitarian purposes, such as, e.g., for lifting, pushing, scraping, digging, plowing and/or various other purposes. As shown in FIG. 1, in some illustrative examples, a utility vehicle 100 can include, e.g., a) a main body 105 having at least one seat for a vehicle operator (such as, for example, a seat located within a protective cab 110), b) wheels 120 and/or other supports mounted on the body portion for supporting the same, and c) one or more utility mechanism 130 mounted to the vehicle (such as, e.g., via a utility boom 140). Often, the utility mechanism(s) can be hydraulically powered and/or controlled. In some illustrative cases, the utility mechanism(s) can include, e.g., one or more of the following: a) an auger; b) a tiller, c) a rotary broom, d) a backhoe; e) a dozer blade; f) a bucket; g) a fork (e.g., for pallets, manure or the like); h) a grinder; i) a rake; j) shears; k) a roller; l) spike (e.g., for bails of hay or the like); m) a jig boom; n) a scraper; o) a tree spade; p) a plow; q) a mower; r) a trencher; s) a four-in-one bucket; and/or various other utility mechanisms. In some instances, the vehicle is adapted such that various utility mechanisms can be replaced, interchanged, upgraded and/or the like. In this manner, in some instances, a basic vehicle can be adapted or configured to perform specific tasks (such as, e.g., by attaching a new utility mechanism to the vehicle).

Because these vehicles are often used for work related purposes, improvements that can reduce manufacturing costs, increase longevity and/or durability, increase performance and/or that can provide other advances can be desirable.

FIG. 5 is a schematic diagram showing one illustrative system similar to that of certain background art that is used to operate a hydraulic cylinder HC of a utility vehicle. In this system, if the fluid in line L2 is high pressure, the flow will be from a female coupler (shown) toward a male coupler (shown) and the fluid will bypass the pilot check valve PCV through the check valve CV1 and will enter the motor HM via a port M2. The fluid will exit the port M1 at a low pressure and will return to the primary system via line L1 and the male coupler. If the solenoid directional valve SDV is energized, there will be high-pressure fluid in both ports A and B of the solenoid valve. This will render the hydraulic cylinder immovable. However, if the fluid flow is reversed, energizing the solenoid valve SDV will allow pressurized fluid (pressure derived from maintaining the pilot check valve PCV in an open position) to flow through port B of solenoid directional valve SDV and exit port C or D depending on the direction the solenoid directional valve SDV is shifted. This action diverts fluid via the shuttle valve and the pilot line PL1 to close the pilot check valve PCV. Flow continues toward either ports H1 or H2 of the hydraulic cylinder HC depending on which direction the solenoid directional valve SDV is shifted and moves the actuator of the hydraulic cylinder HC. Once the pilot check valve PCV is closed, enough pressure is available to allow the actuator in the hydraulic cylinder HC to function (e.g., reciprocate by flow of fluid in and out of ports H1 and H2). Depending on the pressure required to move the actuator of the hydraulic cylinder HC, the hydraulic motor HM experiences a corresponding loss of available pressure. Moreover, once the actuator comes to a limit of its travel, the hydraulic motor HM will stop rotating.

FIG. 6 is a schematic diagram showing another circuit that functions generally similarly to the circuit shown in FIG. 5. The circuits shown in FIGS. 5 and 6 have a number of deficiencies, such as, e.g., deficiencies described below.

With reference to the system depicted in FIG. 5, by way of example, one or more of the following deficiencies may be found.

First, the line pressure loss to keep the pilot check valve PCV open can cause inefficiencies and/or unnecessary system heating.

Second, after the solenoid is energized, all of the flow from the hydraulic motor is diverted through a restrictor and then through the solenoid directional valve SDV and the hydraulic cylinder HC. This can, e.g., unduly slow the hydraulic motor HM and/or can cause unnecessary system heating.

Third, at the time the hydraulic cylinder HC reaches an actuator travel limit, the hydraulic motor HM will stop. This will cause inefficiencies for the operator of the prime mover (such as, e.g., a prime mover effecting overall vehicle movement). The forward motion of the prime mover may have to be altered to allow the unit to perform a uniform operation.

Fourth, the hydraulic cylinder HC can only be operated for one direction of rotation of the hydraulic motor HM.

There remains a need for, among other things, utility devices, such as, e.g., utility vehicles, having utility mechanisms with improved hydraulic systems.

SUMMARY OF THE PREFERRED EMBODIMENTS

The preferred embodiments of the present invention can significantly improve upon existing systems and methods. In some preferred embodiments, a utility device is provided that has an improved hydraulic system.

The preferred embodiments of the present invention can be used to overcome a number of deficiencies in existing systems. First, existing systems are often unnecessarily complex and can be too costly to perform desired functions. Second, existing systems do not effectively enable plural hydraulic functions to be active at the same time—e.g., the operator often must stop one function to operate another function.

In some illustrative embodiments, a utility device can include a utility mechanism with a multi-function valve that changes an orientation (e.g., angular position) of a rotatable element with respect to a drive direction of travel of a prime mover (e.g., vehicle) while the rotatable element is rotated.

In some illustrative embodiments, the operator can advantageously keep a utility mechanism (such as, e.g., a power rake, broom and/or any other appropriate mechanism) moving (such as, e.g., rotating) while its position is adjusted (such as, e.g., to follow the contour of a particular environment, such as, e.g., a curved or irregular boundary, border, driveway and/or the like). Hitherto, existing circuits usually required, for example, that the roller (or the like) rotation be prevented while the roller (or the like) angle was adjusted. This often made it very inconvenient and/or impossible to do some required work.

In some embodiments, a circuit is provided that can enable a rotating element (such as, e.g., a roller) to be moved in opposite directions, such as, e.g., rotated either clockwise CW and/or counter clockwise CCW, at the same time that an orientation (such as, e.g., angular position) of that element is adjusted.

In some embodiments, improved hydraulic circuits, such as, e.g., described herein, can be implemented along with any appropriate utility mechanism(s), such as, e.g., with one or more rotary broom(s), stump grinder(s), concrete saw(s), power rake(s), trencher(s) and/or various other utility mechanisms as would be apparent based on this disclosure. In some illustrative examples, embodiments of the present invention could be used to operate, by way of example, trenchers including rotation of a trencher chain and/or side-shifting of the trencher chain.

According to some preferred embodiments, a utility device having a hydraulically operated utility mechanism can include: a utility mechanism having at least two hydraulic drives; a hydraulic circuit including a pair of feed ports, a first pair of outlet ports to a first of the hydraulic drives and second pair of outlet ports to a second of the hydraulic drives; and the hydraulic circuit including a first fluid circulation path between the feed ports and the first pair of outlet ports and a second fluid circulation path between the feed ports and the second pair of outlet ports, the first fluid circulation path including a pressure drop component and the second fluid circulation path including a directional valve and a shuttling valve arranged to direct fluid to the directional valve from the first fluid circulation path irrespective of a direction of fluid flow in the first fluid circulation path. Preferably, the hydraulic circuit is configured to permit flow through the hydraulic circuit currently. both a) to-or-from the first pair of outlet ports and b) to-or-from the second pair of outlet ports. In some preferred embodiments, the utility mechanism can include a ground-tool and the first of the hydraulic drives can power the ground-tool, such as, e.g., causing an element of the ground-tool to rotate. In some embodiments, the second of the hydraulic drives adjusts a position of the element of the ground-tool, such as, e.g., causing the ground-tool to reciprocate. Preferably, a position of the tool is adjusted via the second of the hydraulic drives at the same time that the first of the hydraulic drives rotates the tool and at the same time that the utility vehicle is driven. In some embodiments, the hydraulic drives can include, e.g., hydraulic motors, hydraulic cylinders and/or other known hydraulic drives.

According to some other preferred embodiments, a utility vehicle can include: a utility mechanism having at least two hydraulic drives; a hydraulic circuit including feed ports, first outlet ports to a first of the hydraulic drives and second outlet ports to a second of the hydraulic drives; and the hydraulic circuit being configured to permit flow through the hydraulic circuit concurrently both a) to-or-from the first outlet ports and b) to-or-from the second outlet ports. Preferably, the first of the hydraulic drives is adjustably supplied with fluid from the hydraulic circuit concurrently with a supply of fluid to the second of the hydraulic drives.

According to some other preferred embodiments, a method for hydraulically operating a utility mechanism of a utility vehicle can include: a) supplying hydraulic fluid into a feed port of a hydraulic circuit for the utility mechanism; b) supplying hydraulic fluid fed into the feed port in a direction along a first circulation path through the hydraulic circuit to cause a first hydraulic drive to operate a power function of the utility mechanism; c) supplying hydraulic fluid fed into the feed port in a direction along a second circulation path through the hydraulic circuit to cause a second hydraulic drive to operate a position function of the utility mechanism; and d) concurrently performing the steps b) and c) while the utility vehicle is driven. In some embodiments, the method further includes: e) supplying hydraulic fluid fed into the feed port in a reverse direction along the first circulation path through the hydraulic circuit to cause the first hydraulic drive to reverse operate the power function of the utility mechanism; f) supplying hydraulic fluid fed into the feed port in a reverse direction along the second circulation path through the hydraulic circuit to cause the second hydraulic drive to reverse operate the position function of the utility mechanism; and g) concurrently performing the steps e) and f) while the utility vehicle is driven. In preferred embodiments, the utility mechanism is a ground-tool having a rotated ground-contact element and the method further includes varying an orientation of the ground-contact element while the ground-contact element is rotated.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The accompanying figures, in which similar references labels depict similar elements, are provided by way of example, without limiting the broad scope of the various embodiments of the invention, wherein.

DETAILED DESCRIPTION OF THE PREFERRED EMBODIMENTS

While embodiments of the present invention may be embodied in many different forms, a number of illustrative embodiments are described herein with the understanding that the present disclosure is to be considered as providing examples of the principles of the invention and that such examples are not intended to limit the invention to preferred embodiments described herein and/or illustrated herein.

The preferred embodiments of the invention include novel hydraulic circuit systems for powering and/or controlling at least one utility mechanism of a utility device, such as, e.g., a utility vehicle. In various embodiments, a novel hydraulic circuit system can be implemented within various utility vehicles, such as various utility vehicles having utility mechanisms with rotatable drive mechanisms, such as for a rotatable brooms, rakes, trenchers and/or the like. The following section describes some non-limiting examples of illustrative vehicles in which some embodiments of the present invention can be implemented. It should be appreciated that these examples are provided by way of illustration only.

Illustrative Vehicle Environment:

While aspects of the invention can be employed within various types of utility devices, some preferred embodiments involve utility vehicle type utility devices. In this regard, the preferred embodiments of the invention can be implemented within a variety of vehicles, such as, for example, within vehicles having a raised and/or lowered utility booms, such as, e.g., various skid steer loaders. The terminology vehicle as used herein encompasses, inter alia, both motorized vehicles and non-motorized vehicles (such as, e.g., trailers or the like). While preferred embodiments described herein show skid steer loaders, it should be appreciated that the various embodiments may be employed within any appropriate vehicle type. While some illustrative vehicle structures are described which include specific utility mechanisms connected to the vehicle, it should be appreciated that the various embodiments may employ any other appropriate utility mechanisms. In many examples, appropriate utility mechanisms include a rotated drive mechanism, such as, for example, some of the utility mechanisms discussed herein and/or otherwise available in the art.

Figure 1:
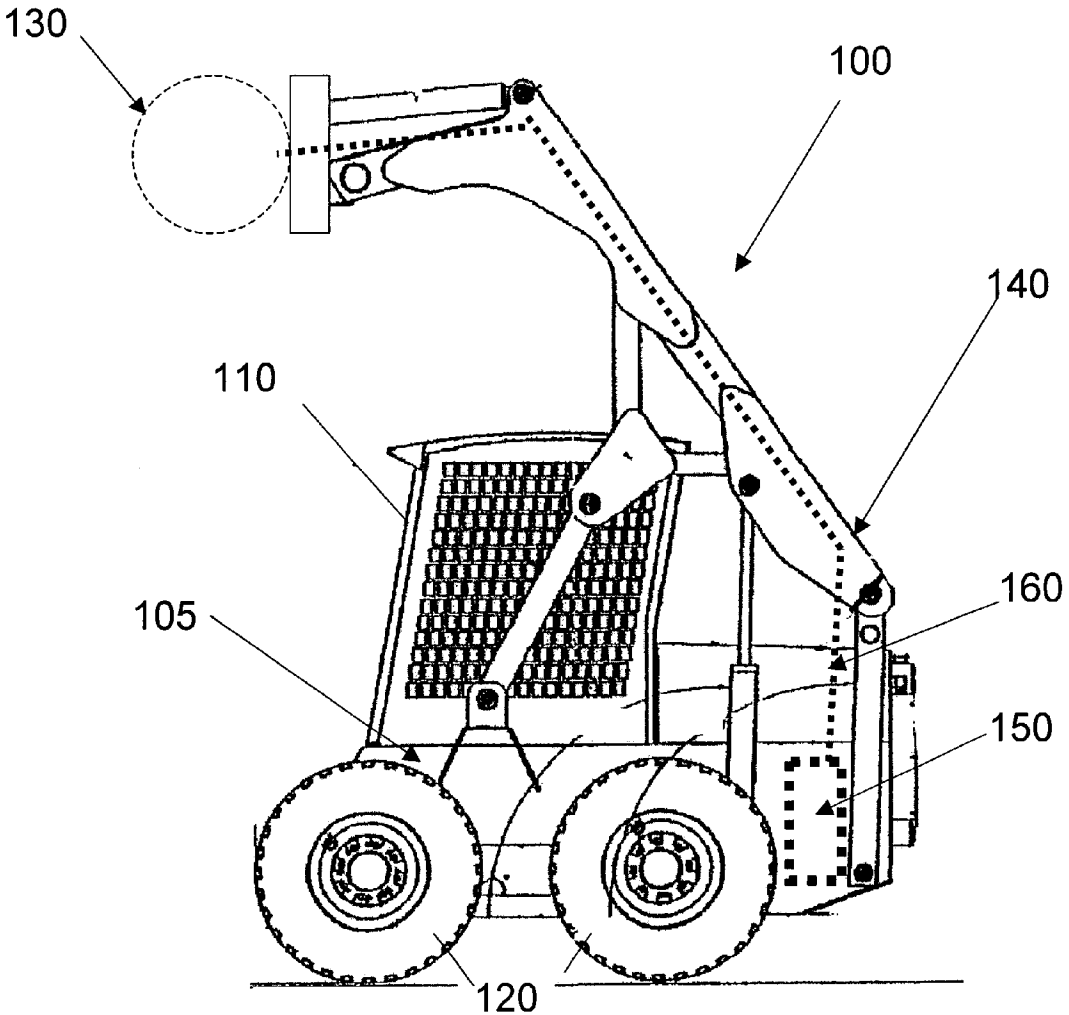
FIG. 1 is a side view of an illustrative utility vehicle within which some illustrative embodiments of the invention may be employed with a boom in a raised position.

FIG. 1 shows an illustrative vehicle in which some preferred embodiments of the invention can be implemented. In this regard, FIG. 1 shows an illustrative embodiment of a skid steer vehicle, by way of example, with a boom in a raised position. It should be appreciated based on this disclosure, the embodiments of the invention can employ other forms of steering and/or can have a boomless structure.

In the illustrated example, the vehicle 100 preferably includes a main body 105. In the illustrated embodiment, the main body 105 is movably supported via a plurality of wheels 120. While the illustrated embodiment includes four wheels, other embodiments can include any other number of wheels and/or can include other support mechanisms such as belts, stabilizers and/or the like. As mentioned above, while the wheels 120 can provide skid steering, other embodiments could include and/or use other forms of steering.

In some preferred embodiments, the vehicle 100 includes an operator cab 110 having at least one seat mounted therein. In some preferred embodiments, a boom 140 is provided that can be located in a lowered position and/or in a raised position (such as, e.g., shown in FIG. 1). As shown in FIG. 1, a boom and/or other mounting structure preferably includes a support for mounting a utility mechanism 130, such as, e.g., a broom, a trencher, an auger and/or any other utility mechanism now or later known in the art. In some embodiments, where a boom 140 is employed, the boom can be raised and/or lowered via at least one hydraulic cylinder.

In some preferred embodiments, the vehicle can include a plurality of user operator controls that control operation of, for example, a vehicle engine, a boom, a utility mechanism (such as, e.g., a broom, trencher or the like) and/or other vehicle functions. These control elements can include, e.g., hand-operated controls (such as lever arms or the like) and/or foot-operated controls (such as, e.g., foot pedals or the like). In some illustrative embodiments, some vehicle functions can include, for example, one or more, preferably all, of the following functions F1–F4:

F1: Motion (such as, e.g., rotation) of a utility mechanism (which can be, e.g., effected via a hydraulic system);

F2: Position (such as, e.g., angular placement) of a utility mechanism (which can be, e.g., effected via a hydraulic system);

F3: Elevation of a boom (which can be, e.g., effected via a hydraulic system); and/or F4: Other vehicle functions (which can be, e.g., effected via a hydraulic system).

It should be appreciated that various other embodiments can involve one or more of the above functions and/or various other functions as would be known in the art and/or as would depend on the circumstances at hand.

In preferred embodiments, a utility vehicle 100, such as, e.g., like that shown in FIG. 1 can include a primary hydraulic system 150 which can include, e.g., hydraulic pumps, a hydraulic system control unit (e.g., which can, e.g., provide digital control of at least portions of the primary hydraulic system 150), hydraulic lines, etc. In some illustrative embodiments, the hydraulic system can be used to carry out one or more, preferably all of the foregoing functions F1 and/or F2 and/or other functions, such as, e.g., the foregoing functions F3 and/or F4. As shown schematically in FIG. 1, the system 150 can be used to supply and/or return hydraulic fluid to and/or from a hydraulic circuit 200 according to some embodiments of the invention, such as, e.g., via lines 160 shown in dashed lines in the illustrated embodiment.

Preferred Hydraulic System for Operation of Utility Mechanism(s)

Figure 2:
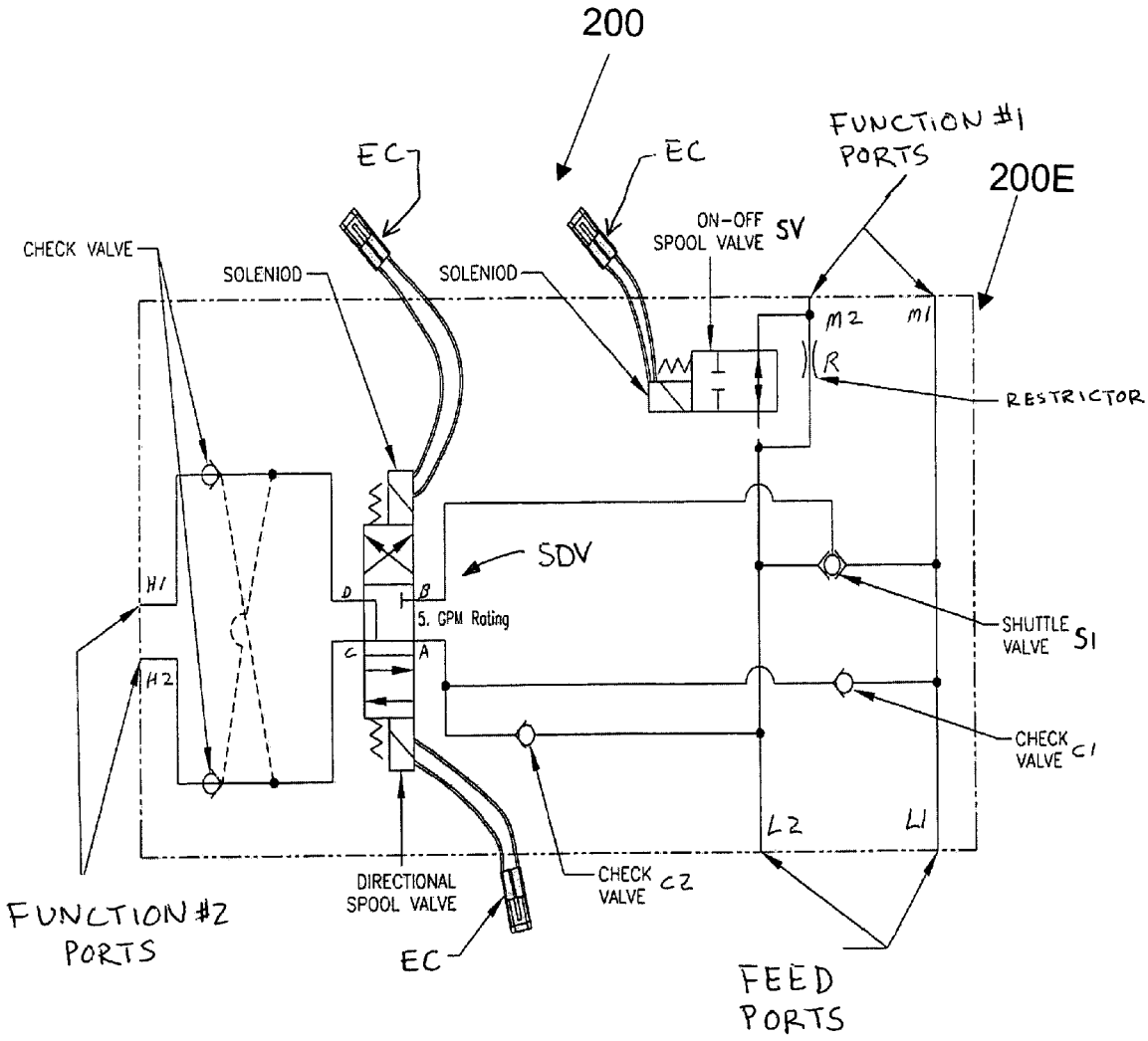
FIG. 2 is a schematic diagram depicting an illustrative hydraulic system that can be employed in some illustrative and non-limiting embodiments of the invention.

FIG. 2 illustrates a schematic diagram depicting an improved hydraulic circuit 200 according to some illustrative embodiments of the invention. In some preferred embodiments, the hydraulic circuit 200 can be contained within a support, housing or enclosure 200E (shown schematically in dashed lines in FIG. 2).

In preferred embodiments, pressurized fluid can be directed to either the port L1 or the port L2 to change the direction of flow out of ports M1 or M2 to the hydraulic motor. For example, in some embodiments, a primary and/or central system, such as, e.g., system 150 shown in FIG. 1 can provide pressurized fluid to the circuit 200. This change of flow direction can preferably be done without substantially effecting the operation of the fluid at ports H1 and H2 leading to, e.g., a hydraulic cylinder HC. Preferably, a shuttle valve S1 feeds pressurized fluid to a port B of a solenoid directional valve SDV in either case (e.g., when flow is in either direction). A lower pressure return fluid from the port A of the solenoid directional valve SDV is preferably directed via check valves C1 or C2 back into a prime mover hydraulic system (such as, e.g., system 150) through either line L1 or L2. The solenoid on-off spool valve SV and the restrictor R preferably provide a free path for fluid to flow in either direction. Preferably, when the solenoid on-off spool valve is energized, fluid is directed through the restrictor alone, thereby creating a pressure drop across the restrictor. Pressurized fluid upstream can then be tapped via the shuttle valve S1 and directed to the solenoid directional valve SDV. In some embodiments, the restrictor R can be somewhat larger than that used in the circuit of FIG. 1. In preferred embodiments, the restrictor R only needs to create a pressure drop sufficient to operate, e.g., a second function when the first function is operating at, e.g., a substantially no-load condition. While a restrictor is used in the preferred embodiments, other embodiments can employ any means that can create a suitable pressure drop.

Preferably, in operation, if either solenoid on the solenoid directional valve SDV is energized, the solenoid on-off valve SV is energized by an electrical circuit (wherein appropriate electrical connections can be imparted via, e.g., electrical connectors EC as shown, such as, e.g., by way of example, using weather pack 2-pin shroud connectors in some illustrative embodiments). This method can, e.g., be used to maintain (e.g., substantially always) a higher pressure to the solenoid directional valve SDV at the port B and a lower pressure at the port A. In operation, fluid entering port B of solenoid directional valve SDV can exit the port C or D depending on the direction the solenoid directional valve SDV is shifted.

In preferred embodiments, the circuit 200 can provide substantially continuous operation of a function driven by the fluid moving through ports M1 and M2 (such as, e.g., to operate a hydraulic motor) while providing fluid to ports H1 and H2 to operate a second function (such as, e.g., to operate a hydraulic cylinder). Preferably, the circuit 200 allows the operator of the prime mover (such as, e.g., a utility vehicle) to continuously manipulate multiple functions without one function substantially affecting the other function. By virtue of preferred embodiments, smooth operating characteristics of a sub-system (such as, e.g., one or more function of a utility mechanism) can be realized, which can, in turn, enhance the efficiency of an overall system (such as, e.g., of an overall utility mechanism or utility vehicle operation).

In some illustrative embodiments, the ports L1 and L2 can involve tube fittings with about ⅞-14 SAE o-ring ports (such as, e.g., in accordance with the Society of Automotive Engineers standards). In some illustrative embodiments, the ports M1 and M2 can also involve tube fittings with about ⅞-14 SAE o-ring ports (such as, e.g., in accordance with the Society of Automotive Engineers standards). In some illustrative embodiments, the ports H1 and H2 can involve tube fittings with about 9/16-18 SAE o-ring ports (such as, e.g., in accordance with the Society of Automotive Engineers standards). In some illustrative embodiments, the hydraulic flow through the ports M1 and/or M2 and/or the ports L1 and/or L2 can be about a maximum of about 30 gallons per minute (GPM). In some illustrative embodiments, the hydraulic flow through the ports H1 and/or H2 can be about a maximum of about 5 gallons per minute (GPM). In some illustrative embodiments, the valve SDV can have about a 5 GPM rating. In some illustrative embodiments, the valve SV can have about a 20 GPM rating. In some illustrative embodiments, the restrictor R can have about a 0.125 diameter orifice. In some variations of these illustrative embodiments, other systems can be employed having similar dimensional proportions. In some other variations, a wide variety of dimensions, etc., can be selected based upon the circumstances. In some illustrative embodiments, the circuit 200 can be contained within a housing 200E having a length of less than about 1.5 feet and a width of less than about 0.75 feet, or having a length of less than 1 foot and a width of less than about 0.5 feet, or having a length of less than about 0.5 feet and a width of less than about 0.3 feet.

Thus, the embodiment shown by way of example in FIG. 2 includes Feed Ports, e.g., L1 and L2 and multiple function ports, including, e.g., Function #1 Ports M1 and M2 and Function #2 Ports H1 and H2. It should be appreciated based on this disclosure that various components can be altered and/or modified as desired as long as one or more principle of at least one embodiment of the present invention is maintained. For example, in other embodiments various valves can be modified based on circumstances as long as, e.g., basic functionality achieved and/or principles are maintained. For example, while solenoids are used to actuate valves in some embodiments described, other valve actuator mechanisms can be employed in other embodiments for any of the disclosed solenoid actuated valves. As another example, while spool valve structures have been described in some embodiments, the valves can include any appropriate type or structure.

Figure 3A:
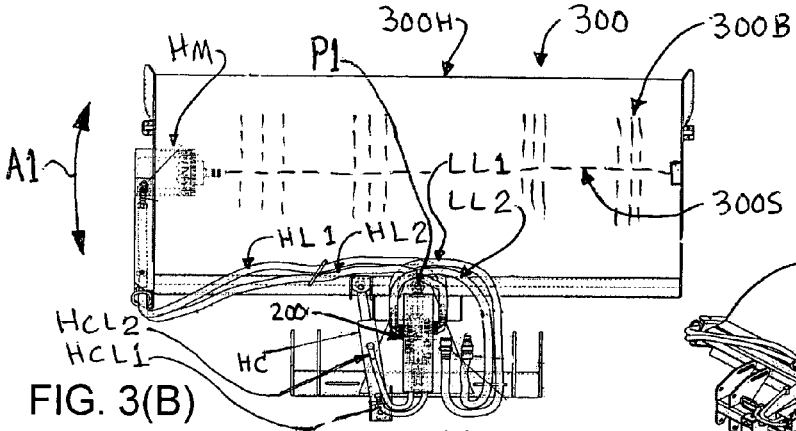
FIGS. 3(A), 3(B) and 3(C) show a hydraulic system employed in some illustrative embodiments to operate a rotary broom of a utility vehicle.
Figure 3B:
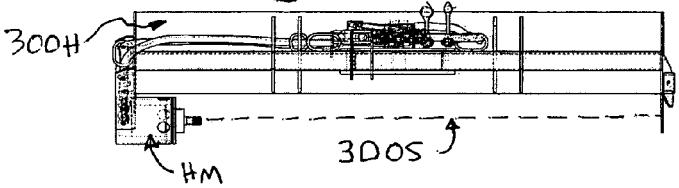
Figure 3C:
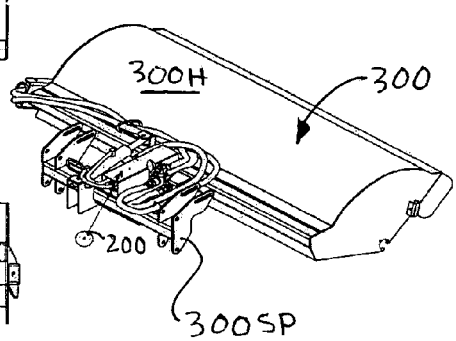

FIGS. 3(A)–3(C) show a hydraulic system according to some embodiments of the invention employed within a framework of a rotary broom device 300. In some illustrative and non-limiting embodiments, such a rotary broom device 300 can be employed upon a vehicle similar to that shown in FIG. 1, such as, e.g., as utility mechanism 130. As shown, the rotary broom device 300 can include a broom 300B that is rotatably mounted so as to rotate around a central shaft 300S and/or central axis. In addition, the rotary broom device 300 is also preferably adjustably mounted such as to enable adjustment of the angular orientation of the broom (such as, e.g., to enable adjustment with respect to a main body 105 of a vehicle, such as, e.g., like that depicted in FIG. 1).

FIG. 3(A) shows a top view of a rotary broom device 300 including a cover or housing 300H that extends over the broom when in a use position. In addition, the broom device 300 can preferably be mounted to a vehicle (such as, e.g., like that shown in FIG. 1) via a support 300SP or mounting structure. As shown in FIG. 3(A), the rotary broom device 300 preferably includes a pivot P1 whereby the broom 300B can be angularly adjusted with respect to the support 300SP. For example, a hydraulic cylinder HC can be mounted between a frame structure that supports the broom 300B and the support 300SP such that operation of the cylinder HC will cause the broom 300B to angularly move as depicted by the arrows A1 shown in FIG. 3(A). In the illustrative device, a hydraulic circuit 200, which can employ features like that described above, is used to direct hydraulic fluid to both a hydraulic motor HM (via lines HL1 and HL2) and the hydraulic cylinder HC (via lines HC1 and HC2). In this manner, the hydraulic circuit can enable a dual functionality, including (1) powering the hydraulic motor HM so as to cause rotation of the shaft 300S and (2) powering the hydraulic cylinder HC so as to cause displacement of the rotary broom device 300.

Figure 4A:
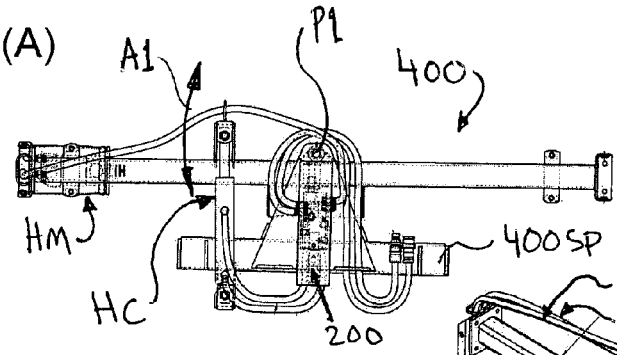
FIGS. 4(A), 4(B) and 4(C) show a hydraulic system employed in some illustrative embodiments to operate a power rake of a utility vehicle.
Figure 4B:
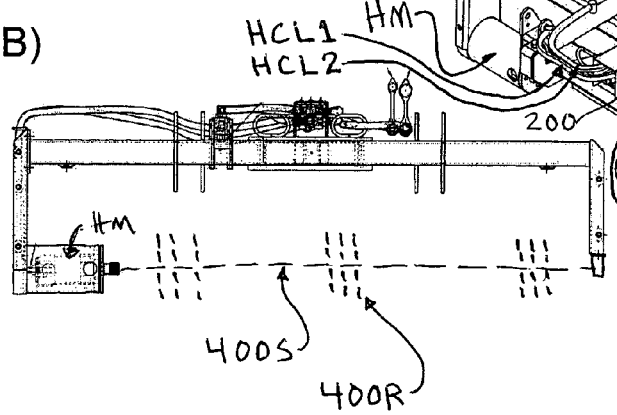
Figure 4C:
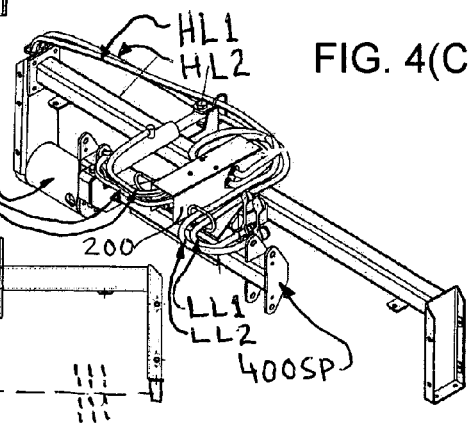
Figure 6:
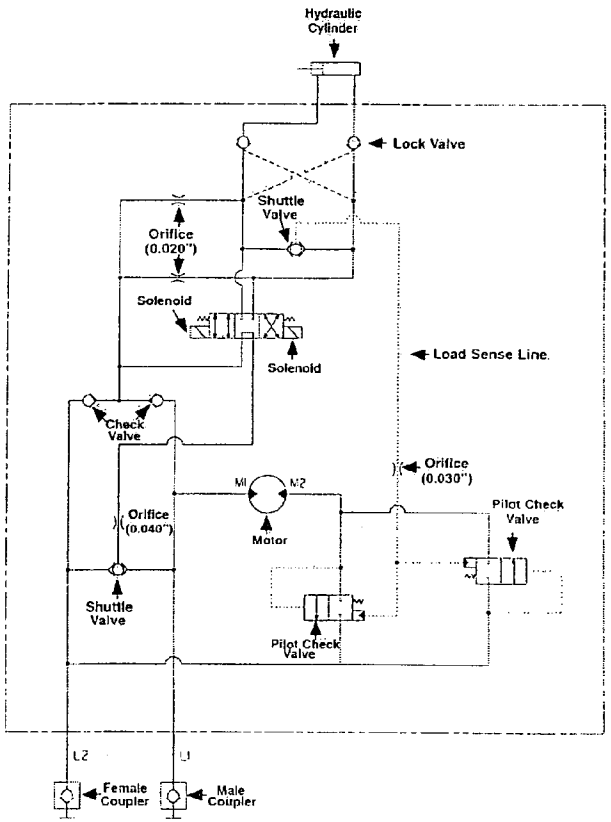
FIG. 6 Background Art
FIGS. 5–6 show two hydraulic systems similar to that employed in some background systems.
Figure 5:
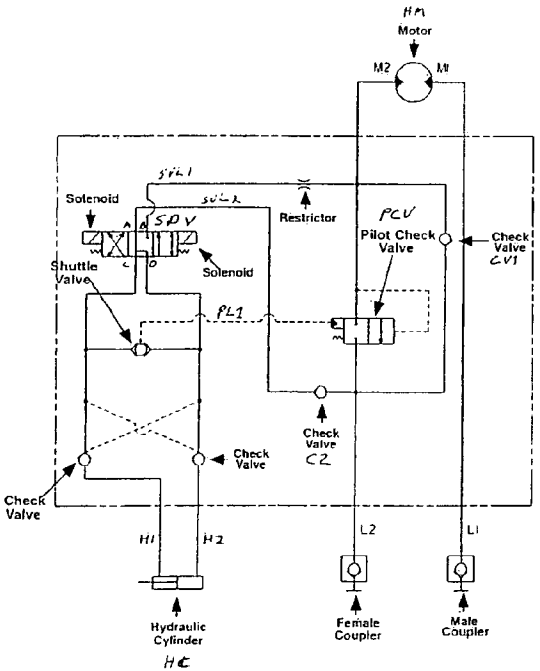
FIG. 5 Background Art

FIGS. 4(A)–4(C) show an hydraulic system according to some embodiments of the invention employed within a framework of a power rake device 400. In some illustrative and non-limiting embodiments, such a power rake can be employed upon a vehicle similar to that shown in FIG. 1, such as, e.g., as utility mechanism 130. As shown in FIG. 4(A), the power rake device 400 preferably includes a pivot P1 whereby a rotated rake 400R can be angularly adjusted with respect to the support 400SP. For example, a hydraulic cylinder HC can extended between a frame structure that supports the rake 400R and the support 400SP such that operation of the cylinder HC will cause the rake 400R to angularly move as depicted by the arrows A1 shown in FIG. 4(A). In the illustrative device, a hydraulic circuit 200, which can employ features like that described above, is used to direct hydraulic fluid to both a hydraulic motor HM (via lines HL1 and HL2) and the hydraulic cylinder HC (via lines HC1 and HC2). In this manner, the hydraulic circuit can enable a dual functionality, including (1) powering the hydraulic motor HM so as to cause rotation of the shaft 400S and (2) powering the hydraulic cylinder HC so as to cause displacement of the rake 400.

Alternative Embodiments:

In various alternative embodiments, principles herein can be employed within various other power tool utility mechanisms having plural functions. In some preferred embodiments, the utility mechanisms can include both motion control (such as, e.g., varying rotation, linear movement and/or the like) and position control (such as, e.g., varying an orientation, a height, an angular or other position and/or the like).

Broad Scope of the Invention:

While illustrative embodiments of the invention have been described herein, the present invention is not limited to the various preferred embodiments described herein, but includes any and all embodiments having modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In some illustrative and non-limiting embodiments, some or all elements can be formed substantially proportional and to scale as that shown in the accompanying figures, but, in various embodiments, the structure of the various embodiments can vary widely based on circumstances

What is claimed is:

1. A utility device having a hydraulically operated utility mechanism, comprising:

a) a utility mechanism having at least two hydraulic drives;

b) a hydraulic circuit including a pair of feed ports, a first pair of outlet ports to a first of said hydraulic drives and second pair of outlet ports to a second of said hydraulic drives; and c. said hydraulic circuit including a first fluid circulation path between said feed ports and said first pair of outlet ports and a second fluid circulation path between said feed ports and said second pair of outlet ports, said first fluid circulation path including a pressure drop component and said second fluid circulation path including a directional valve and a shuttling valve arranged to direct fluid to said directional valve from said first fluid circulation path irrespective of a direction of fluid flow in said first fluid circulation path.

2. The utility device of claim 1, wherein said hydraulic circuit is configured to permit flow through said hydraulic circuit currently both a) to-or-from said first pair of outlet ports and b) to-or-from said second pair of outlet ports.

3. The utility device of claim 2, wherein said utility device is a utility vehicle.

4. The utility device of claim 3, wherein said utility mechanism includes a ground-tool and said first of said hydraulic drives powers said ground-tool.

5. The utility device of claim 4, wherein said first of said hydraulic drives causes an element of said ground-tool to rotate.

6. The utility device of claim 4, wherein said second of said hydraulic drives adjusts a position of said element of said ground-tool.

7. The utility device of claim 6, wherein said second of said hydraulic drives causes said ground-tool to reciprocate.

8. The utility device of claim 3, wherein a position of said tool is adjusted via said second of said hydraulic drives at the same time that said first of said hydraulic drives rotates said tool and at the same time that said utility vehicle is driven.

9. The utility device of claim 8, wherein said first of said hydraulic drives is a hydraulic motor and said second of said hydraulic drives is a hydraulic cylinder.

10. The utility device of claim 1, wherein said second circulation path includes check valves for returning fluid to said first circulation path.

11. The utility device of claim 1, wherein said directional valve is a solenoid directional valve.

12. The utility device of claim 1, wherein said first circulation path further includes an on-off valve in parallel to said pressure drop component.

13. The utility device of claim 1, wherein said pressure drop component is a restrictor.

14. A method for hydraulically operating a utility mechanism of a utility vehicle, comprising:

a) supplying hydraulic fluid into a feed port of a hydraulic circuit for said utility mechanism;

b) supplying hydraulic fluid fed into said feed port in a direction along a first circulation path through said hydraulic circuit to cause a first hydraulic drive to operate a power function of said utility mechanism;

c) supplying hydraulic fluid fed into said feed port in a direction along a second circulation path through said hydraulic circuit to cause a second hydraulic drive to operate a position function of said utility mechanism;

d) concurrently performing said steps b) and c) while said utility vehicle is driven;

e) supplying hydraulic fluid fed into said feed port in a reverse direction along said first circulation path through said hydraulic circuit to cause said first hydraulic drive to reverse operate the power function of said utility mechanism;

f) supplying hydraulic fluid fed into said feed port in a reverse direction along said second circulation path through said hydraulic circuit to cause said second hydraulic drive to reverse operate the position function of said utility mechanism; and g) concurrently performing said steps e) and f) while said utility vehicle is driven.

15. The method of claim 14, wherein said first hydraulic drive is a hydraulic motor.

16. The method of claim 14, wherein said second hydraulic drive is a hydraulic cylinder.

17. The method of claim 14, wherein said utility mechanism is a ground-tool having a rotated ground-contact element and further including varying an orientation of said ground-contact element while said ground-contact element is rotated.

* * * * *